United States Patent [19]

Rotherham

[11] Patent Number: 4,990,017

[45] Date of Patent: Feb. 5, 1991

[54] EXPANDABLE DOUBLE RING BINDER

[76] Inventor: Donald A. Rotherham, 165 Canterbury Rd., Williston Park, N.Y. 11596

[21] Appl. No.: 560,121

[22] Filed: Jul. 31, 1990

[51] Int. Cl.[5] ..... B42F 13/22

[52] U.S. Cl. ..... 402/75; 402/80 R; 402/502

[58] Field of Search ..... 402/73, 74, 75, 76, 402/77, 78, 79, 80 R, 80 P, 80 L, 502

[56] References Cited

U.S. PATENT DOCUMENTS

| | | | |
|---|---|---|---|
| 1,037,292 | 9/1912 | Morden | 402/21 |
| 4,180,341 | 12/1979 | Langhorst | 402/80 R |
| 4,943,177 | 7/1990 | Jordan et al. | 402/75 X |

*Primary Examiner*—Paul A. Bell

*Attorney, Agent, or Firm*—Andrus, Sceales, Starke & Sawall

[57] ABSTRACT

An expandable double ring binder for carrying and displaying swatches of material samples includes a pair of loose leaf ring metals slidably mounted on a carriage attached to the inside of the backbone of a loose leaf binder case, such that the ring metals may be spread apart laterally when the case is opened to a distance sufficient to allow the samples attached to each ring metal to be fully accessed for examination, removal or the like without interference by the other ring metal and samples attached thereto. Each ring metal is secured to a slide plate which, in turn, is slidably attached to an underlying slotted carriage plate by rivets extending loosely through the slots and attached to a slide plate follower on the underside of the carriage plate. The carriage plate is riveted or otherwise attached to the inside surface of the backbone of the binder preferably spaced slightly therefrom with an appropriate spacer plate to permit relatively unrestricted sliding movement of the slide plate followers between the carriage plate and the backbone.

12 Claims, 2 Drawing Sheets

FIG. 1
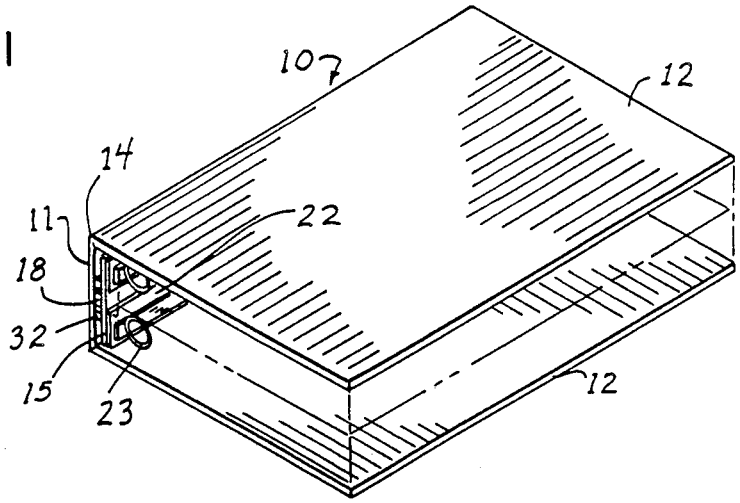
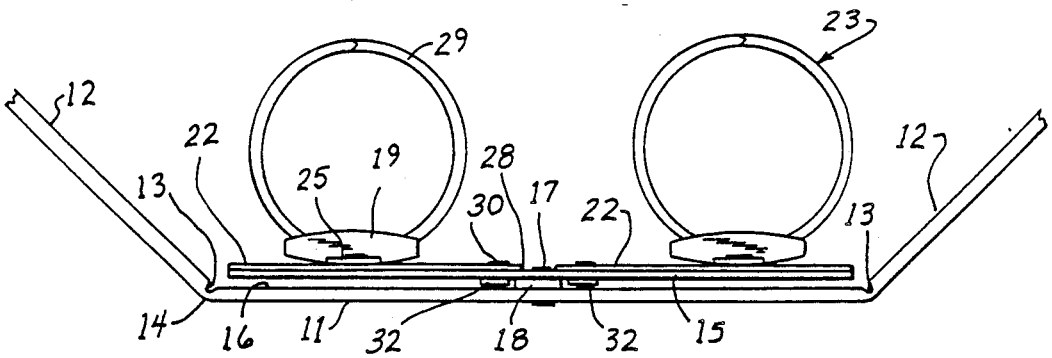
FIG. 3
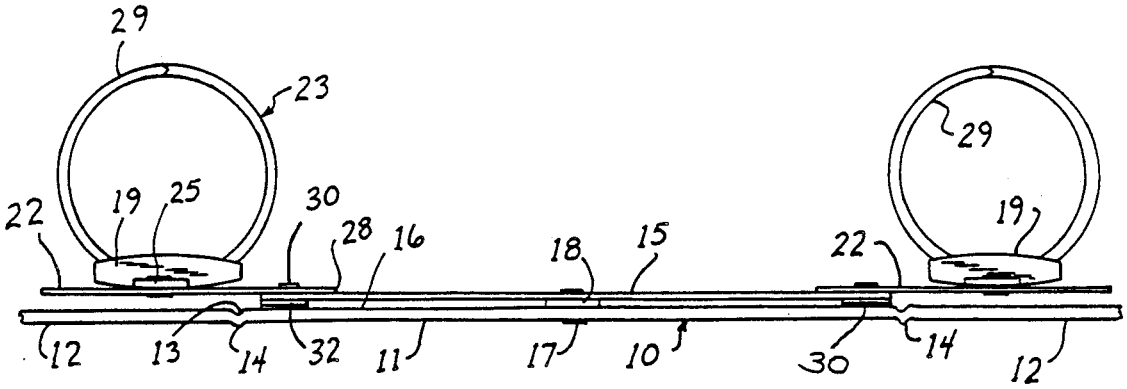
FIG. 4
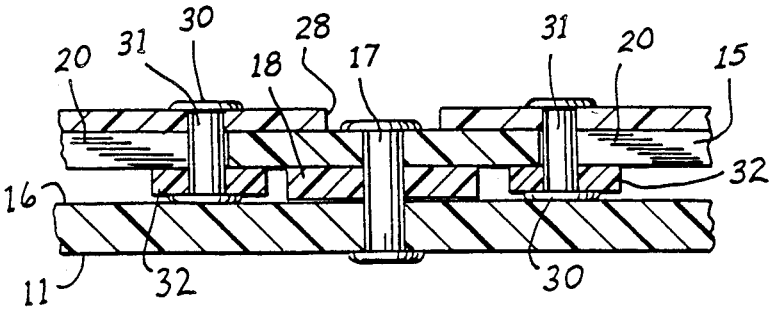
FIG. 5

EXPANDABLE DOUBLE RING BINDER

BACKGROUND OF THE INVENTION

The present invention pertains to binder cases for carrying and displaying sheet material samples and, more particularly, to an expandable ring binder which can accommodate two separate material-holding ring metals in a manner allowing relative lateral movement between them.

Loose leaf ring binders are old and well known. They are used to demountably attach sheets or layers of various types of material within a case or cover, so that they are protected and easily transportable, but may be readily accessed for viewing and removal when the cover is open. Ring binders with relatively large diameter rings are often used to carry and display samples of bulky sheet materials, such as wall coverings, ribbons, carpeting, fabrics and the like. It is also known to mount a pair of loose leaf binder rings, commonly called ring metals, in spaced parallel relation to increase the capacity of the binder or case. Typically, two adjacent ring metals are mounted in fairly close spaced parallel relation on a single panel of the binder, such as the inside of the back or backbone of the binder. This tends to crowd the sets of samples attached to the adjacent ring metals and makes complete access to individual samples difficult because of interference from the stack of samples attached to the adjacent ring metal. This compact arrangement not only often restricts full view of the sample, but may also inhibit removal of samples from the binder.

It would be desirable, therefore, to utilize a double ring metal binder for the convenience and compact storage which it provides, but which would also provide freer and more open access to the samples of materials hung on the rings. In particular, it would be desirable if the materials on each ring metal could be flipped in either direction and lie flat without interfering contact with the adjacent ring metal and samples attached thereto.

SUMMARY OF THE INVENTION

In accordance with the present invention, an expandable double ring binder is provided in which each of the ring metals is movable laterally with respect to the other when the binder cover is open to separate the ring metals by a distance at least equal to the width of the samples. The samples on each ring metal may then be readily leafed through in a completely flat and open manner.

In its most basic embodiment, a case for carrying and displaying sheets of sample materials includes a mounting base attached to an interior surface of the case and a pair of loose leaf ring metals positioned in parallel spaced relation on the mounting base. Means are provided for slidably attaching the ring metals to the mounting base in a manner which permits relative lateral movement between the ring metals while they are retained in their parallel spaced relation.

In the preferred embodiment of the invention, the mounting base comprises a flat generally rectangular carriage which is provided with a plurality of spaced parallel slots that are elongated in the direction of movement of the ring metals. An intermediate slide is positioned between each ring metal and the mounting base, the ring metal is fixed to the intermediate slide, and fasteners are secured to the slide to extend loosely through the slots in the mounting base where they are attached to a follower on the underside of the mounting base in a manner allowing the slide and attached ring metal to slide along the length of the slots.

The display case preferably comprises a generally conventional binder including a back member or backbone and pair of covers attached to opposite edges of the back member in a hinged manner. The slotted mounting base is positioned t overlie and is attached to the inside surface of the back member. The mounting base comprises a thin rigid carriage plate with a set of spaced parallel slots for each intermediate slide and attached ring metal.

BRIEF DESCRIPTION OF THE PREFERRED EMBODIMENT

FIG. 1 is an isometric view of the expandable binder of the present invention with the cover shown closed.

FIG. 3 is an end elevation of the expandable binder assembly shown in FIG. 1 with the ring metals in their closely spaced closed positions.

FIG. 4 is an end elevation, similar to FIG. 3, showing the ring metals slit apart to their maximum spaced positions.

FIG. 5 is an enlarged detail, partly in section, of the mounting and slide assembly shown in FIGS. 3 and 4.

DETAILED DESCRIPTION OF THE PREFERRED EMBODIMENT

Figure 2:
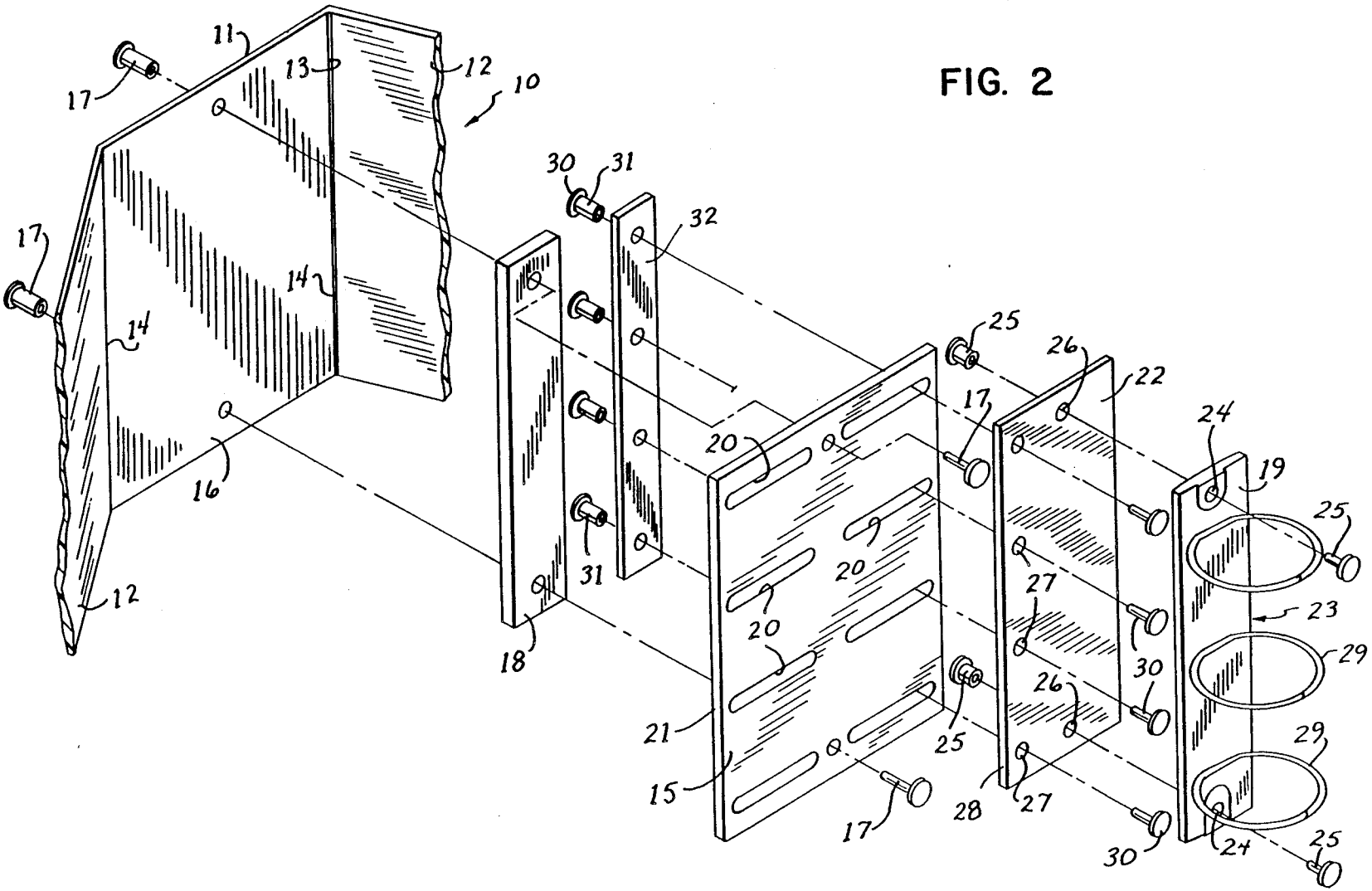
FIG. 2 is an exploded isometric view, similar to FIG. 1, showing all of the components of the assembly of the present invention.

The expandable ring binder of the present invention is adapted to be used with a conventional loose leaf binder case 10 comprising a back member or backbone 11 in a pair of covers 12. In accordance with conventional construction, each of the covers 12 is attached to an opposite edge 13 of the backbone 11 with a hinged connection 14. The hinged connections 14 allow the case to be opened flat with the backbone and covers lying coplanar or closed to enclose the contents, all in a well known manner.

The backbone 11 of the binder case is substantially wider in the dimension between the opposite edges 13 than a conventional binder in order to accommodate the double ring metal construction to be described. A carriage plate 15 is attached to the inside surface 16 of the backbone with a series of aligned rivets 17 disposed along the centerline of the carriage plate and the backbone midway between the edges 13. The carriage plate 15 is preferably spaced from the surface 16 of the backbone by a spacer bar 18 positioned between the carriage plate and the backbone and through which the connecting rivets 17 extend.

The carriage plate 15 is provided with two identical sets of spaced parallel slots 20, each of which sets is positioned between the spacer bar 18 and one of the long edges 21 of the carriage plate and generally perpendicular thereto. Overlying each set of parallel spaced slots 20 is a slide plate 22 to the upper surface of which is attached a three-ring binder clamp or ring metal 23. Each of the ring metals 23 is of conventional construction and includes a base 19 which is provided with mounting holes 24 for rivets 25 extending through aligned mounting holes 26 in the slide plate 22 for attachment thereto.

Each of the slide plates 22 is provided with a series of slide mounting holes 27 on a line parallel to and closely spaced from the inside edge 28 of the plate. One end of a slide rivet 30 is secured in each slide mounting hole 27 and the shank 31 of the rivet 30 extends with appropriate clearance through one of the slots 20 in the carriage plate 15 with the opposite end of the rivet 30 secured in a slide follower 32 positioned below the carriage plate in the space provided by the spacer bar 18. Each slide follower 32 comprises a narrow strip similar to the spacer bar 18 and has a length just slightly greater than the distance between the most remote of the slots 20 in each set. A slide rivet 30 is thus disposed in each slot 20 with the rivets holding each slide plate 22 and attached slide follower 32 spaced apart by a distance slightly greater than the thickness of the intermediate carriage plate 15, such that the slide plate and follower will slide easily along the carriage plate 15.

Referring particularly to FIGS. 3 and 4, the ring metals 23 are attached to their respective slide plates 22 to position the ring metal 23 generally in the center of the set of slots 20 when the slide plates 22 are slid to their most closely spaced positions shown in FIG. 3. In this position, the ring metals 23 are appropriately spaced to accommodate a substantially full ring of material samples and the slide plates 22 are fully within the opposite edges 13 of the backbone 11, thereby allowing the covers 12 to be folded and closed. Preferably, when the slide rivets 30 engage the inside ends of the slots 20 in the closed position, the adjacent edges 28 of the slide plates 22 are just slightly spaced from one another.

When the slide plates and attached ring metals are slid along the slots to the fully open or expanded position shown in FIG. 4, the slide rivets 30 engage the outside ends of the respective slots 20. In this position, the ring metals 23 and most of the slide plates 22 are extended laterally beyond the edges 13 of the backbone 11 such that they overlie the inside surfaces of the covers 12. In this position, the covers are of course open and lie coplanar with the backbone. The positioning of the ring metals on the slide plates with respect to the position of slide rivets 30 and the lengths of the slots 20 are chosen to space the ring metals in their fully open FIG. 4 positions at a distance just slightly greater than the length of the material samples from the point of attachment to the rings 29 to the opposite sample edge. In this manner, the material samples may be positioned such that all of the samples on one set of rings may be leafed in a completely open manner from one side to the other without having the samples touch the rings of the opposite ring metal 23 or the material samples attached thereto. When it is desired to close the binder case 10 each ring metal/slide plate combination is slid back to its closed FIG. 3 position where it no longer overlie the cover 12, thereby allowing the hinged connections 14 to operate without obstruction to close the case.

The edges of the covers 12, opposite the hinged connections 14, may be provided with a suitable closure device of a well known type to hold the binder case in its fully closed position. The closure device may also include a carrying handle or, alternately, a handle (not shown) may also be attached to the outside surface of the backbone 11, all in a known manner.

The expandable binder of the present invention may be utilized with many types of commercially available center opening loose leaf ring metals, including round, oval, trapezoidal, or D configurations. The binder case 10 may also be of any conventional type, including casebound, sealed vinyl, or rigid plastic sheets. The carriage plates 15, slide plates 22, slide followers 32 and spacer bar 18 may be made from metal or rigid plastic material.

Various modes of carrying out the present invention are contemplated as being within the scope of the following claims particularly pointing out and distinctly claiming the subject matter which is regarded as the invention.

I claim:

1. An expandable binder for carrying and displaying a plurality of pieces of material comprising:

a display case;

a mounting base attached to the interior of said case;

a pair of loose leaf ring metals disposed in parallel spaced relation on said mounting base; and, means for slidably attaching said ring metals to said mounting base to permit relative lateral movement between said ring metals while retaining their parallel spaced relation.

2. The apparatus as set forth in claim 1 wherein said mounting base comprises a flat generally rectangular carriage, said carriage having slot means extending in the direction of lateral movement of said ring metals for receipt of said attaching means.

3. The apparatus as set forth in claim 2 comprising:

an intermediate slide disposed between each ring metal and said mounting base;

means for fixedly securing each ring metal to one intermediate slide; and, wherein said attaching means includes fasteners attached to said slides and extending through said slot means.

4. The apparatus as set forth in claim 3 wherein said slot means comprises a plurality of spaced parallel slots.

5. The apparatus as set forth in claim 4 including a pair of followers disposed between said carriage and the interior surface of said case, each of said followers positioned to receive the opposite ends of the fasteners attached to one of said slides and to move therewith along said slots.

6. The apparatus as set forth in claim 5 including a spacer positioned between said followers and between said carriage and the interior surface of said case.

7. The apparatus as set forth in claim 1 wherein said display case comprises a binder, said binder including a back member and a pair of covers hingedly attached to opposite edges of said back member.

8. The apparatus as set forth in claim 7 wherein said mounting base generally overlies and is attached to the inside surface of said back member.

9. The apparatus as set forth in claim 8 wherein said mounting base comprises a thin rigid carriage plate, said carriage plate having a plurality of spaced parallel slots extending perpendicular to said opposite edges of said back member and in the direction of lateral movement of said ring metals.

10. The apparatus as set forth in claim 9 wherein said attaching means comprises:

a slide plate for each ring metal, said slide plate secured to said ring metal and overlying a portion of said carriage plate;

a slide follower for each slide plate positioned below the carriage plate and said slide plate, said slide follower underlying and extending perpendicular to said slots;

a plurality of fasteners, each attached at one end to a slide plate and extending slidably through one of said slots, each fastener attached at its other end to one of said slide followers.

11. An expandable binder for carrying and displaying a plurality of pieces of sample material, said binder comprising:

an outer enclosure including back member and a pair of covers hingedly attached to opposite edges of the back member;

a pair of loose leaf ring metals positioned in parallel spaced relation along the inside surface of the back member and parallel to said opposite edges; and, means for movably attaching said ring metals to said back member to allow each of said ring metals to be moved laterally with respect to the other ring metal in a direction generally perpendicular to said opposite edges.

12. The apparatus as set forth in claim 11 wherein said attaching means comprises slide means separately interconnecting each of said ring metals with said back member for moving said ring metal beyond one of said opposite edges to a position overlying the inside surface of the cover attached at said edge when said cover is open and lying substantially coplanar with said back member.

* * * * *